US011229821B2

(12) United States Patent
McDougle

(10) Patent No.: US 11,229,821 B2
(45) Date of Patent: Jan. 25, 2022

(54) EXERCISE DEVICE

(71) Applicant: Todd McDougle, Noblesville, IN (US)

(72) Inventor: Todd McDougle, Noblesville, IN (US)

( * ) Notice: Subject to any disclaimer, the term of this patent is extended or adjusted under 35 U.S.C. 154(b) by 13 days.

(21) Appl. No.: 16/750,833

(22) Filed: Jan. 23, 2020

(65) Prior Publication Data

US 2021/0228940 A1 Jul. 29, 2021

(51) Int. Cl.

| | |
|---|---|
| ***A63B 23/02*** | (2006.01) |
| ***A63B 21/00*** | (2006.01) |
| ***A63B 21/04*** | (2006.01) |
| ***A63B 21/055*** | (2006.01) |
| ***A63B 23/04*** | (2006.01) |
| ***A63B 21/06*** | (2006.01) |

(52) U.S. Cl.

CPC ..... *A63B 23/0233* (2013.01); *A63B 21/0428* (2013.01); *A63B 21/0552* (2013.01); *A63B 21/0615* (2013.01); *A63B 21/4011* (2015.10); *A63B 21/4029* (2015.10); *A63B 23/04* (2013.01); *A63B 2210/50* (2013.01)

(58) Field of Classification Search

CPC ..... A63B 21/4029; A63B 21/4011; A63B 21/0552; A63B 21/0428; A63B 23/04; A63B 21/0615; A63B 2210/50; A63B 21/00058; A63B 21/00061; A63B 21/00065; A63B 21/02–028; A63B 21/0407; A63B 21/0435; A63B 21/0442; A63B 21/05–0557; A63B 21/0728; A63B 21/159; A63B 21/4027; A63B 21/4031; A63B 21/4041; A63B 21/4047; A63B 2022/0033; A63B 22/0048–2022/0053; A63B 23/02; A63B 23/0216; A63B 23/0238; A63B 2023/003; A63B 23/0233–0238

See application file for complete search history.

(56) References Cited

U.S. PATENT DOCUMENTS 4,930,771 A * 6/1990 Wilson ..... A63B 23/0216 482/145
5,066,003 A * 11/1991 Jones ..... A63B 23/03508 482/137

(Continued)

OTHER PUBLICATIONS

Titan Fitness, "Economy H-PND", oldest review date of Dec. 20, 2018, retrieved from the Internet: https://www.titan.fitness/strength/specialty-machines/lower-body/economy-h-pnd/401027.html (Year: 2018).*

*Primary Examiner* — Megan Anderson
*Assistant Examiner* — Kathleen Vermillera

(57) ABSTRACT

An exercise device for targeted exercise of a lower back of a user includes a frame that can be positioned on a substantially horizontal surface. A plate is pivotally coupled to an apex of the frame to support a torso of a user in a selectable position relative to horizontal. Legs of the user extend over a front edge of the plate. A bar is hingedly coupled to the apex of the frame equally distant from opposing faces of the frame and is positioned to alternately swing toward the front edge and a rear edge of the plate when strapped to the legs of the user and with the user moving the legs in a pendulous motion. A resistance module is coupled to the bar distal from the plate and resists the swinging of the bar to exercise the lower back of the user.

15 Claims, 8 Drawing Sheets

(56) References Cited

U.S. PATENT DOCUMENTS

| | | | | |
|---|---|---|---|---|
| 5,135,459 | A * | 8/1992 | Perry, Jr. | A63B 21/00047 482/144 |
| 5,356,359 | A * | 10/1994 | Simmons | A63B 21/0615 482/137 |
| 5,472,401 | A * | 12/1995 | Rouillard | A63B 23/0233 482/142 |
| 6,491,607 | B2 * | 12/2002 | Simmons | A63B 23/0233 482/93 |
| 7,435,207 | B2 | 10/2008 | Cook | |
| 7,473,212 | B2 | 1/2009 | Simmons | |
| 7,691,041 | B2 * | 4/2010 | Abdo | A63B 21/4047 482/142 |
| 7,699,763 | B2 * | 4/2010 | Perry, Jr. | A61H 1/0292 482/144 |
| 7,704,200 | B2 | 4/2010 | Rahimi | |
| 8,529,413 | B2 | 9/2013 | Simmons | |
| 9,211,431 | B2 | 12/2015 | Hornback | |
| 9,375,599 | B1 * | 6/2016 | Simmons | A63B 24/0087 |
| 10,737,134 | B2 * | 8/2020 | Anderson | A63B 23/0216 |
| 2007/0054787 | A1 * | 3/2007 | Simmons | A63B 23/03525 482/97 |
| 2008/0207414 | A1 | 8/2008 | Cook | |
| 2012/0165168 | A1 * | 6/2012 | Simmons | A63B 21/0615 482/139 |
| 2019/0015695 | A1 | 1/2019 | Simmons | |

* cited by examiner

EXERCISE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise devices and more particularly pertains to a new exercise device for targeted exercise of a lower back of a user.

(2) Description of Related Art Including Information Disclosed Under 37 CFR 1.97 and 1.98

The prior art relates to exercise devices. Prior art devices that target the lower back may comprise a platform and a swingable weight.

BRIEF SUMMARY OF THE INVENTION

An embodiment of the disclosure meets the needs presented above by generally comprising a frame that is configured to position on a substantially horizontal surface. A plate that is pivotally coupled to an apex of the frame is configured to support a torso of a user, in a selectable position relative to horizontal, with legs of the user extending over a front edge of the plate. A bar that is hingedly coupled to the apex of the frame equally distant from opposing faces of the frame is positioned to alternately swing toward the front edge and a rear edge of the plate when strapped to the legs of the user and with the user moving the legs in a pendulous motion. A resistance module that is coupled to the bar distal from the plate is configured to resist the swinging of the bar to exercise a lower back of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
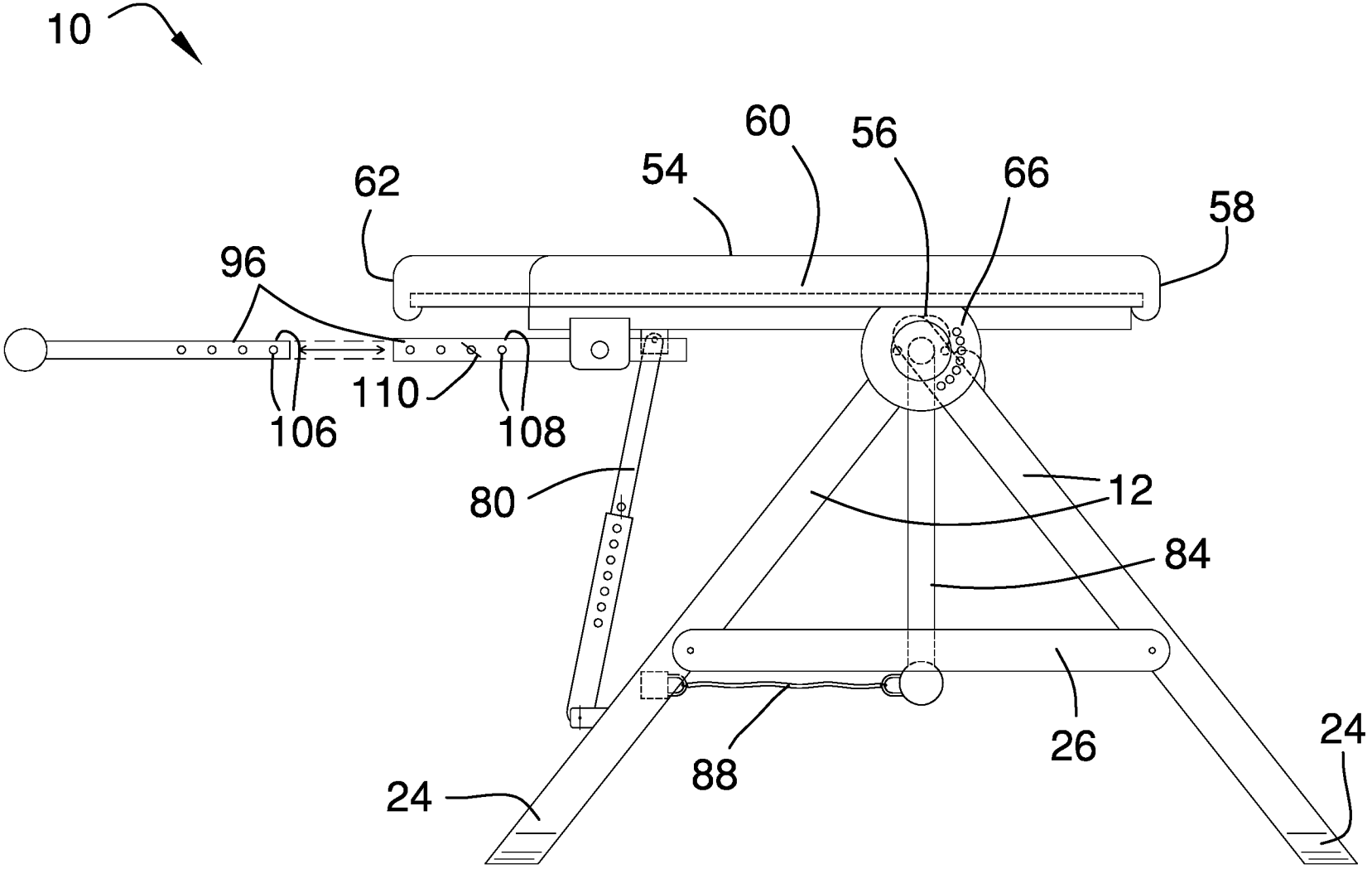
FIG. 1 is a side view of an exercise device according to an embodiment of the disclosure.

With reference now to the drawings, and in particular to FIGS. 1 through 9 thereof, a new exercise device embodying the principles and concepts of an embodiment of the disclosure and generally designated by the reference numeral 10 will be described.

Figure 2:
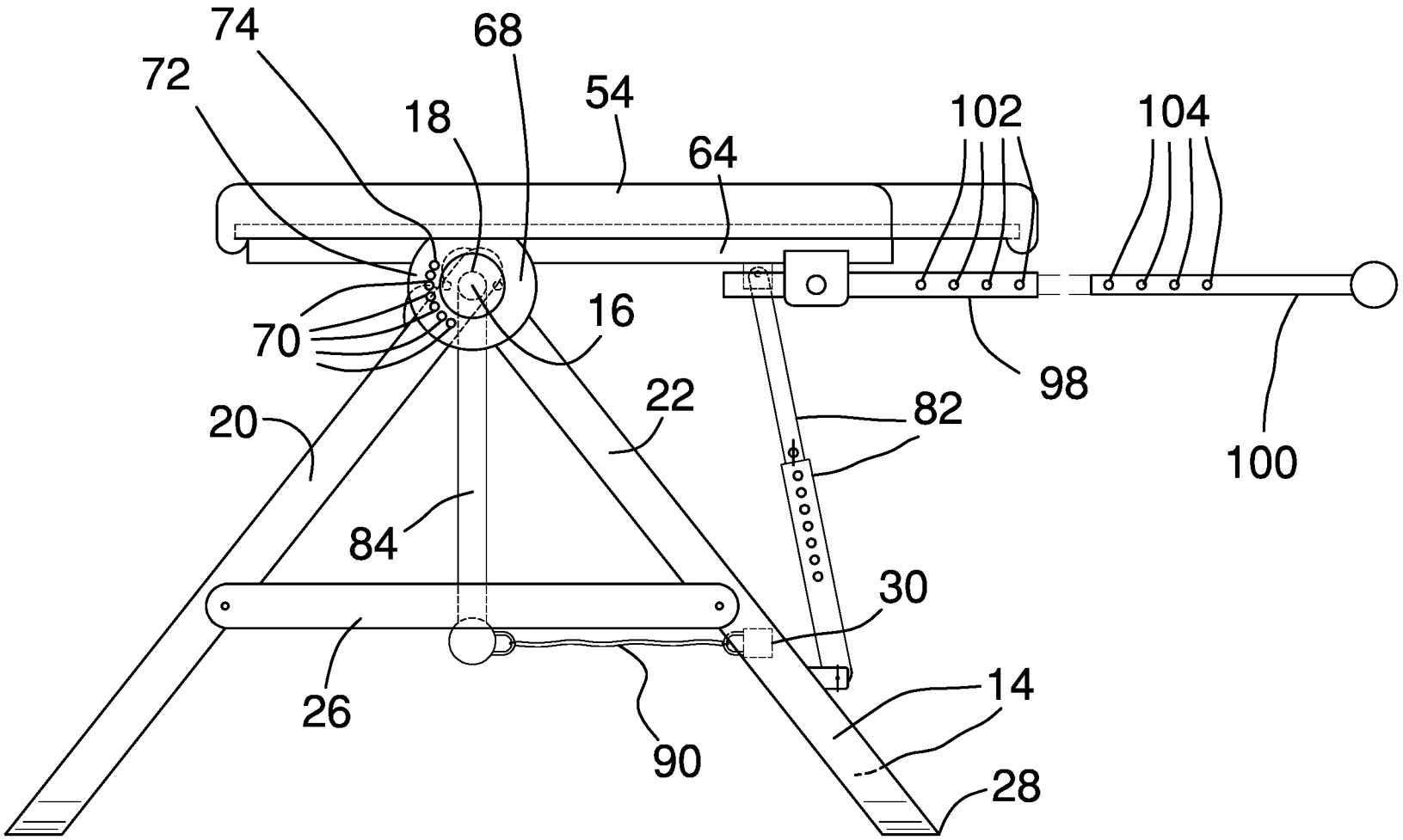
FIG. 2 is a side view of an embodiment of the disclosure.
Figure 4:
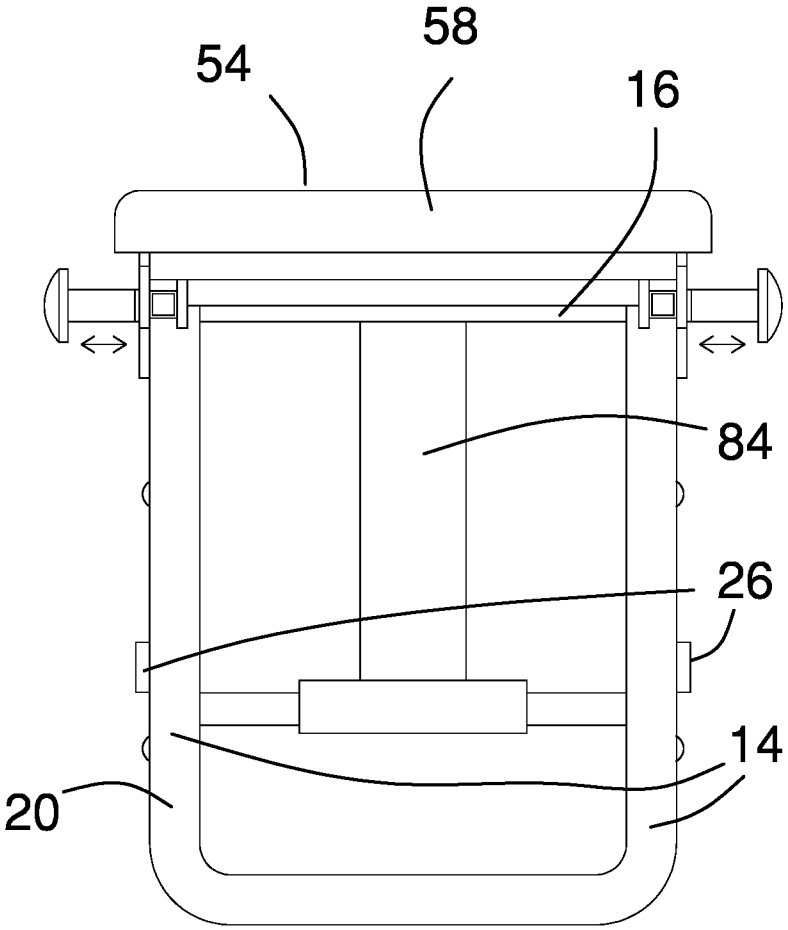
FIG. 4 is a front view of an embodiment of the disclosure.
Figure 3:
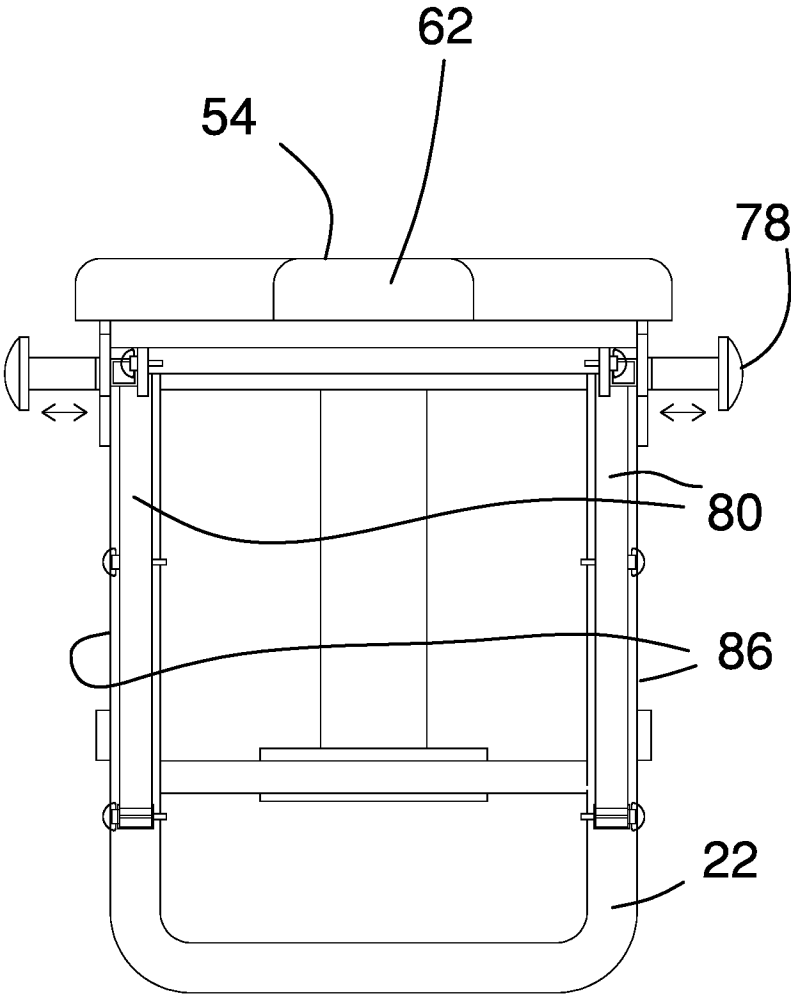
FIG. 3 is a rear view of an embodiment of the disclosure.
Figure 5:
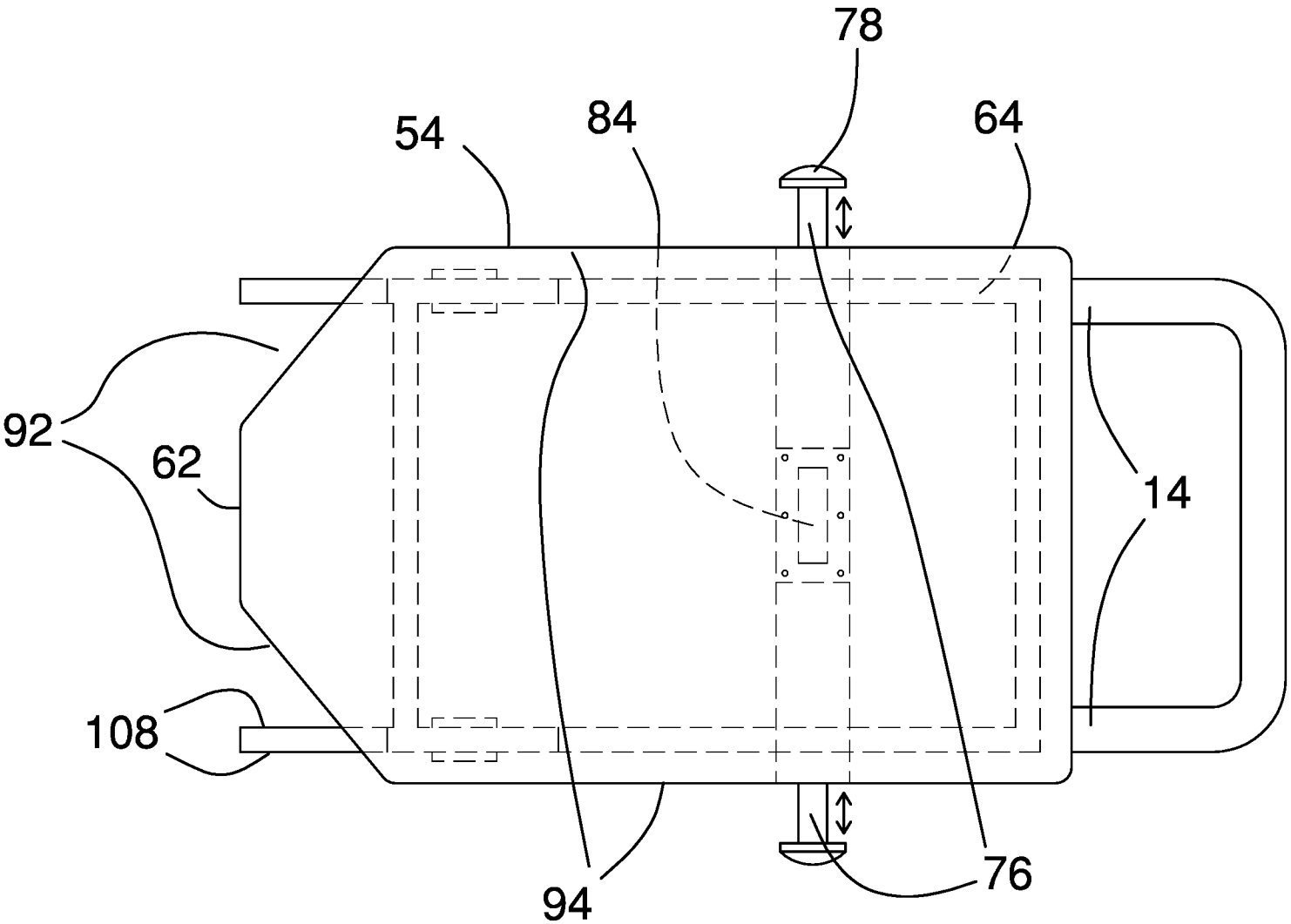
FIG. 5 is a top view of an embodiment of the disclosure.
Figure 6:
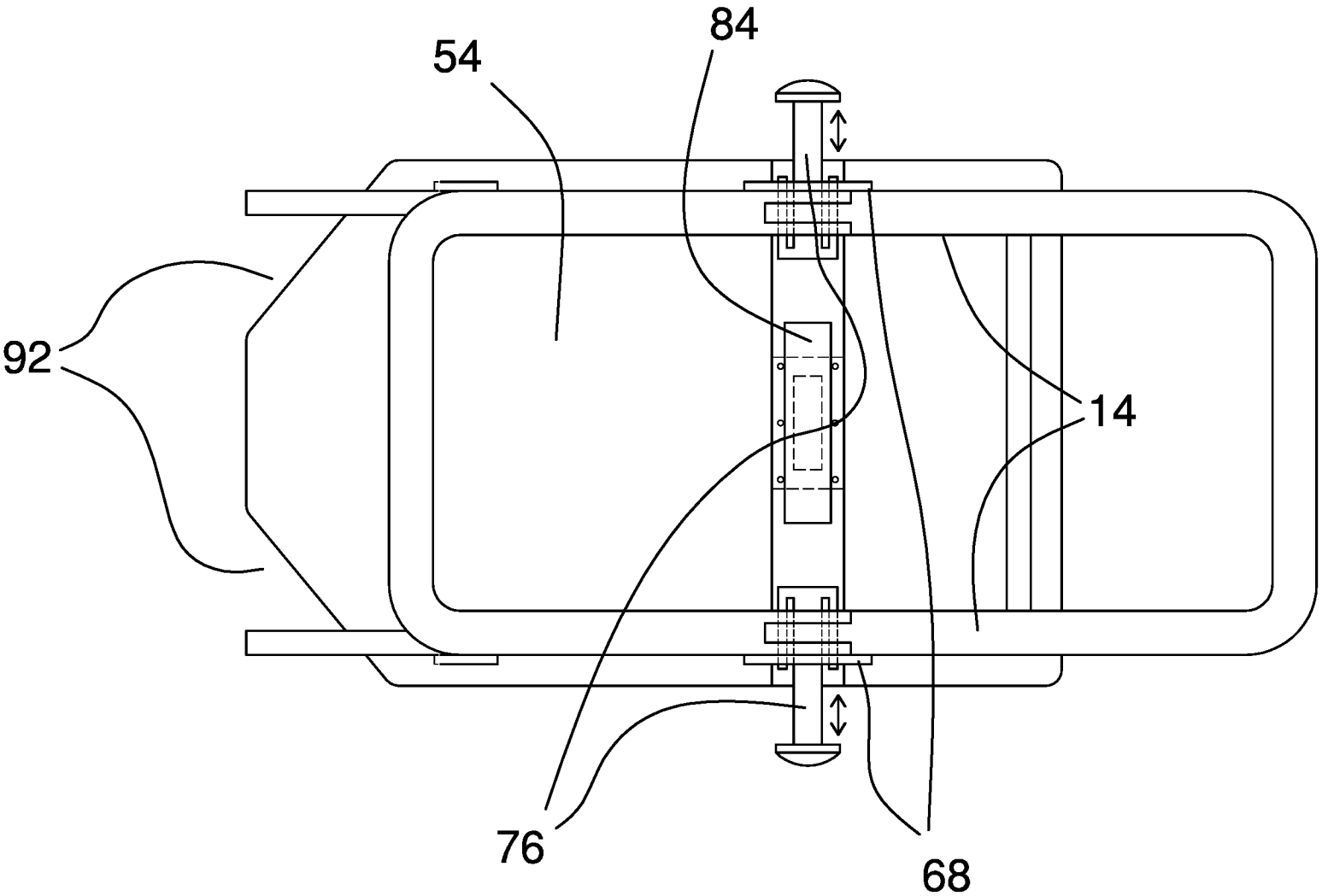
FIG. 6 is a bottom view of an embodiment of the disclosure.

As best illustrated in FIGS. 1 through 9, the exercise device 10 generally comprises a frame 12 that is configured to be positioned on a substantially horizontal surface. The frame 12 may comprise a pair of side members 14 and a crossmember 16, as shown in FIGS. 1-6. The side members 14 may be inverted V-shaped, as shown in FIG. 2, or may be alternatively shaped, such as inverted U-shaped, rectangularly shaped, and the like. The crossmember 16 is coupled to an upper end 18 of each side member 14 so that the crossmember 16 extends between the side members 14.

Each side member 14 comprises a front segment 20 and a rear segment 22. At least one of the front segment 20 and the rear segment 22 is hingedly coupled to the crossmember 16 so that the frame 12 is selectively collapsible. A set of feet 24 that is coupled to the side members 14 is configured to stabilize the frame 12 on the substantially horizontal surface.

Each of a pair of side crossbars 26 is coupled to and extends between the front segment 20 and the rear segment 22 of a respective side member 14. The side crossbar 26 is positioned substantially equally distant from the upper end 18 and a lower end 28 of the respective side member 14. The side crossbar 26 is removably couplable to at least one of the front segment 20 and the rear segment 22 so that the frame 12 is selectively collapsible. A fastener 30 is coupled to a respective rear segment 22 proximate to the side crossbar 26. As will become apparent below, the fastener 30 can be used for attachment of one or more of a set of elastomeric bands 90.

Figure 7:
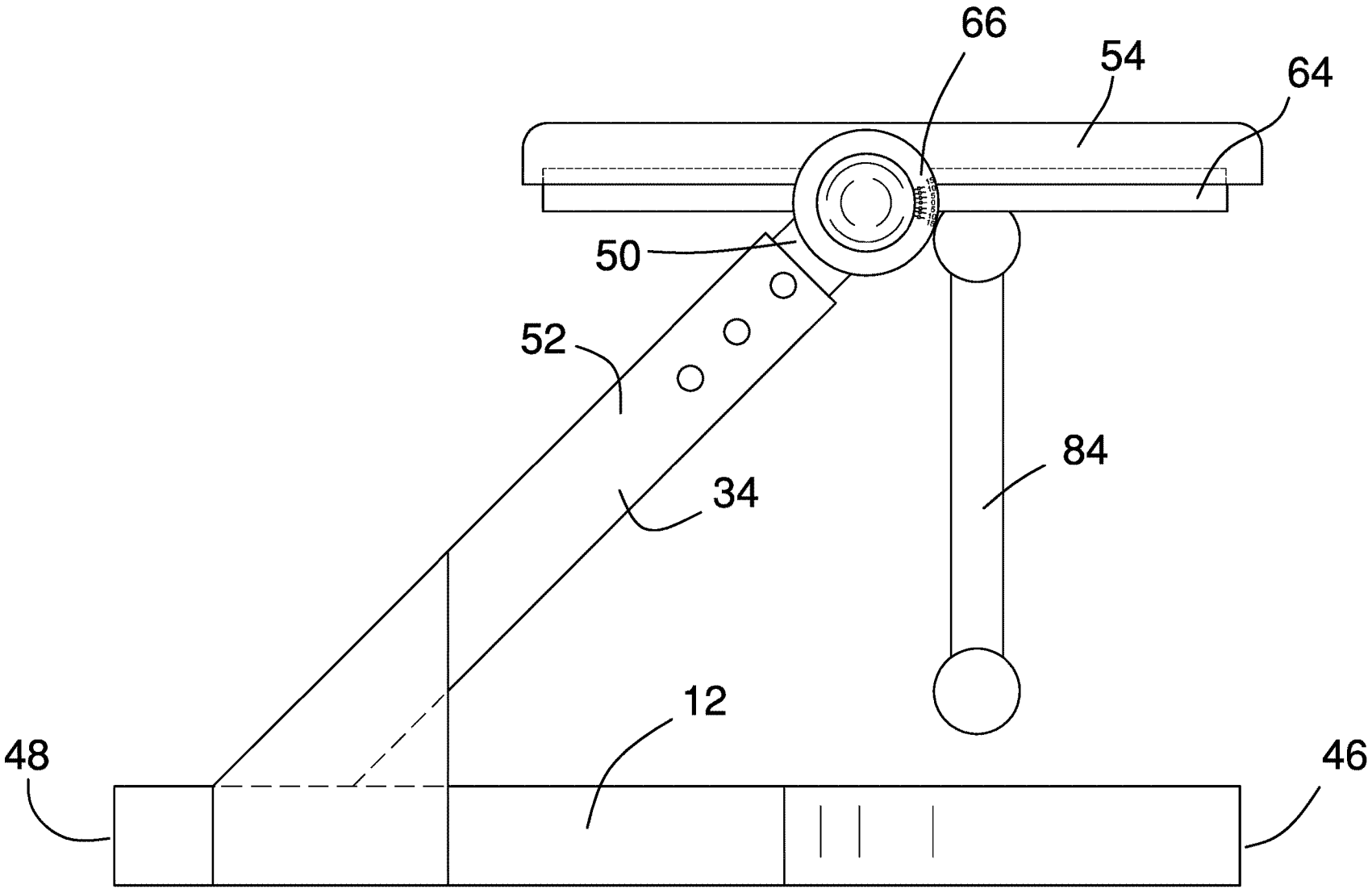
FIG. 7 is a side view of an alternative embodiment of the disclosure.
Figure 8:
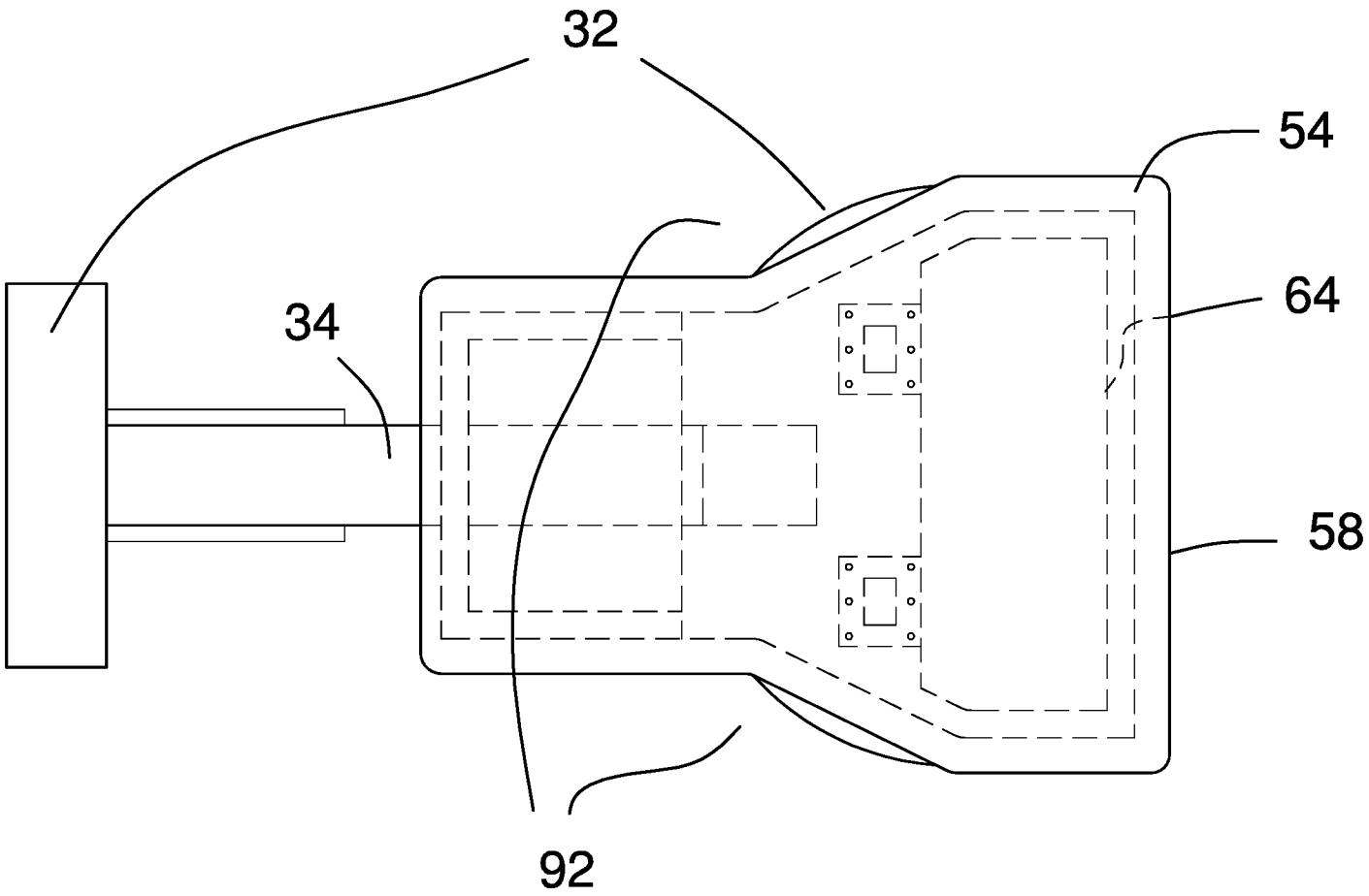
FIG. 8 is a top view of an alternative embodiment of the disclosure.
Figure 9:
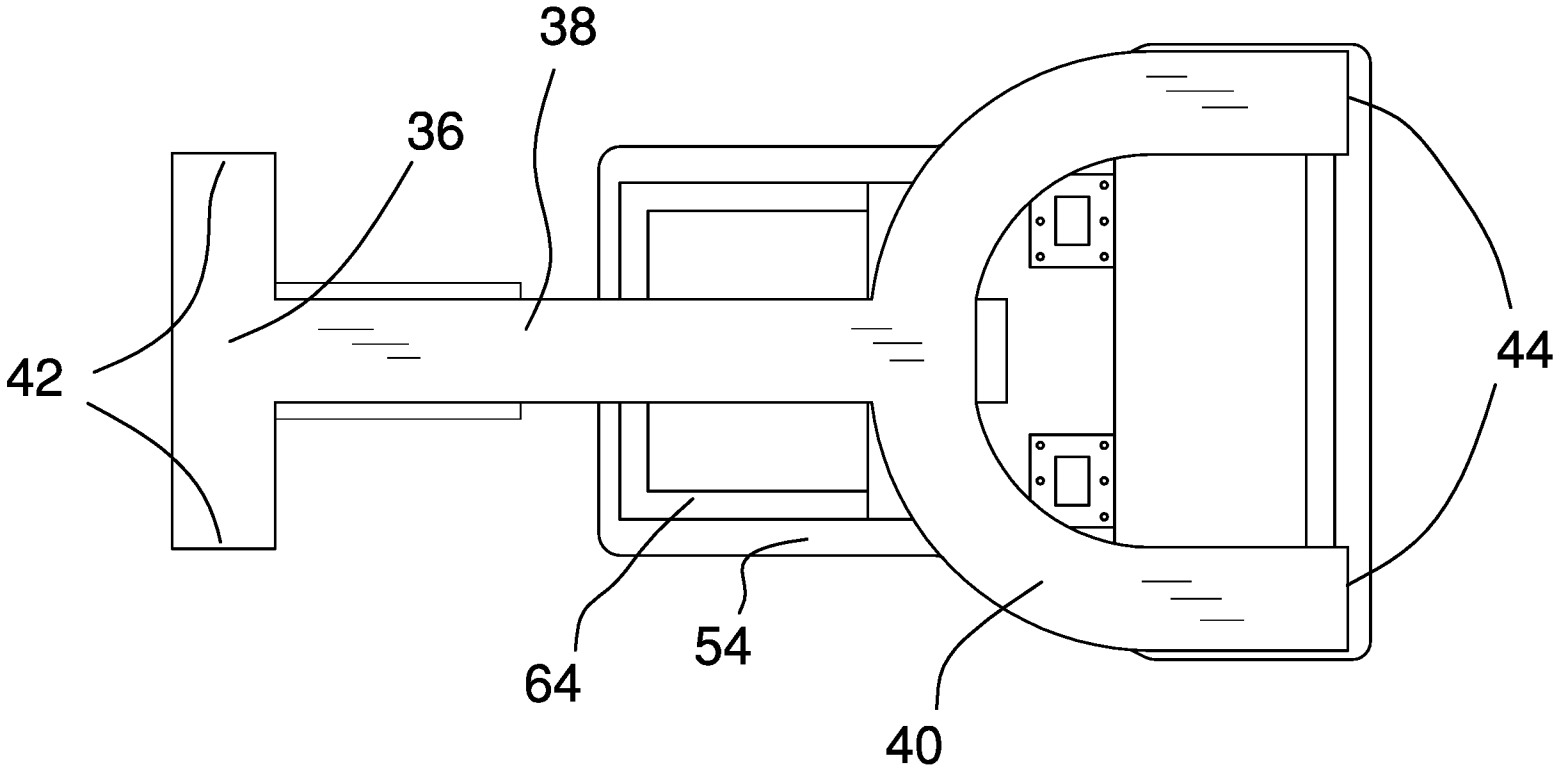
FIG. 9 is a bottom view of an alternative embodiment of the disclosure.

In another embodiment, as shown in FIGS. 7-9. The frame 12 comprises a base 32 and an arm 34. The base 32 comprises a first section 36, a second section 38, and a third section 40. The first section 36 and the second section 38 are linear, and the third section 40 is substantially C-shaped. The second section 38 is coupled to and extends from the first section 36 equally distant from opposing endpoints 42 of the first section 36. The third section 40 is coupled to the second section 38 distal from the first section 36. The second section 38 is positioned equally distant from opposing termini 44 of the third section 40.

The arm 34 is coupled to and extends transversely from a forward end 46 of the base 32 toward a rearward end 48 of the base 32. The arm 34 comprises an upper segment 50 that is selectively extensible from a lower segment 52.

A plate 54 that is pivotally coupled to an apex 56 of the frame 12 is configured to support a torso of a user in a selectable position relative to horizontal with legs of the user extending over a front edge 58 of the plate 54, The plate 54 may be padded using materials such as, but not limited to, foamed elastomers, rubbers, and silicones. The apex 56 of the frame 12 is positioned between a midpoint 60 and a front edge 58 of the plate 54. In the alternative embodiment shown in FIGS. 7-9, the plate 54 is pivotally coupled to the arm 34 distal from the base 32 so that the plate 54 is selectively pivotable relative to horizontal.

A truss 64 is coupled to and positioned between the plate 54 and the frame 12. The truss 64 is open rectangularly shaped so that the truss 64 is positioned to retain the plate 54 in a planar configuration.

A tilting means 66 is coupled to the frame 12. The tilting means 66 is operationally coupled to the plate 54 so that the plate 54 is selectively tillable relative to the frame 12. The plate 54 is selectively tillable between −15 and 15 degrees relative to horizontal. The tilting means 66 may comprise a pair of discs 68, each of which is coupled to the truss 64 and positioned adjacent to a respective side member 14 proximate to the apex 56.

Each disc 68 has a set of first apertures 70 positioned therein. Each side member 14 has second apertures 72 positioned therein proximate to the apex 56. The second aperture 72 is selectively alignable with a respective first aperture 70 as the plate 54 is tilted relative to the frame 12. A tilt pin 74 is selectively insertable into the respective first aperture 70 and the second aperture 72 to fixedly position the plate 54 relative to the frame 12.

Each of a pair of push pins 76 is coupled to a respective side member 14. The push pin 76 is spring loaded so that the push pin 76 defaults to an inserted position wherein the front segment 20 is fixedly coupled to the rear segment 22. A knob 78 of the push pin 76 is configured to be grasped in a hand of a user, positioning the user to pull on the push pin 76 to decouple the front segment 20 from the rear segment 22 to collapse the frame 12.

Each of a pair of rods 80 is pivotally coupled to and extends between the rear segment 22 of a respective side member 14 and the truss 64 to stabilize the plate 54 relative to the frame 12. The rod 80 comprises a plurality of nested sections 82 so that the rod 80 is selectively extensible to allow tilting of the plate 54.

A bar 84 is hingedly coupled to the apex 56 of the frame 12 equally distant from opposing faces 86 of the frame 12 and is positioned to alternately swing toward the front edge 58 and the rear edge 62 of the plate 54 when strapped to the legs of the user and with the user moving the legs in a pendulous motion. A resistance module 88 is coupled to the bar 84 distal from the plate 54 and is configured to resist the swinging of the bar 84 to exercise a lower back of the user. The resistance module 88 comprises at least one of a set of weights (not shown) and the set of elastomeric bands 90.

The plate 54 has a pair of cutouts 92 positioned therein, each of which extends from a respective opposing side 94 to the rear edge 62 of the plate 54. The cutouts 92 are configured to facilitate movement of arms of the user who is positioned upon the plate 54.

Each of a pair of handgrips 96 is coupled to the plate 54 proximate to respective opposing side 94 of the plate 54 and extends past the rear edge 62 of the plate 54. Each handgrip 96 comprises a first segment 98 and a second segment 100. The first segment 98 is coupled to the truss 64 so that the first segment 98 is parallel to the plate 54. The second segment 100 is selectively extensible from and couplable to the first segment 98.

The first segment 98 has a set of first holes 102 positioned therein. The second segment 100 has a set of second holes 104 positioned therein. A respective pair of second holes 106 of the set of second holes 104 is selectively alignable with a respective pair of first holes 108 of the set of first holes 102, positioning the respective pair of second holes 106 and the respective pair of first holes 108 for insertion of a hand pin 110 to removably couple the second segment 100 to the first segment 98.

In use, the user approaches the front edge 58 of the plate 54 and straps his or her legs to the bar 84. The user then positions his or her torso on the plate 54 and swings his or her legs in a pendulous manner. The resistance module 88 provides resistance to the swinging of the bar 84, thus exercising the lower back of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. An exercise device comprising:

a frame configured for positioning on a horizontal surface;

a plate pivotally coupled to an apex of the frame wherein the plate is configured for supporting a torso of a user in a selectable position relative to horizontal with legs of the user extending over a front edge of the plate;

a bar hingedly coupled to the apex of the frame equally distant from opposing faces of the frame such that the bar is positioned for alternately swinging toward the front edge and a rear edge of the plate when strapped to the legs of the user and with the user moving the legs in a pendulous motion;

a resistance module coupled to the bar distal from the plate wherein the resistance module is configured for resisting swinging of the bar for exercising a lower back of the user;

wherein the frame comprises a pair of side members, the pair of side members being inverted V-shaped, and a crossmember, the crossmember being coupled to an upper end of each of the pair of side member such that the crossmember extends between the pair of side members;

each of the pair of side members comprising a front segment and a rear segment, at least one of the front segment and the rear segment of each of the pair of side members being hingedly coupled to the crossmember such that the frame is selectively collapsible; and a pair of side crossbars, each of the pair of side crossbars being coupled to and extending between the front segment and the rear segment of a respective side member of the pair of side members, each of the pair of side crossbars being positioned equally distant from the upper end and a lower end of the respective side member, each of the pair of side crossbars being removably couplable to at least one of the front segment and the rear segment of the respective side member such that the frame is selectively collapsible.

2. The exercise device of claim 1, further including a truss coupled to and positioned between the plate and the frame, the truss being open rectangularly shaped such that the truss is positioned for retaining the plate in a planar configuration.

3. The exercise device of claim 2, further including a tilting means coupled to the frame, the tilting means being operationally coupled to the plate such that the plate is selectively tillable relative to the frame, the plate being selectively tiltable between −15 and 15 degrees relative to horizontal.

4. The exercise device of claim 3, wherein the tilting means comprises:

a pair of discs, each of the pair of discs being coupled to the truss and positioned adjacent to a respective side member of the pair of side members proximate to the apex, each of the pair of discs having a set of first apertures positioned therein; and each of the pair of side members having a second aperture positioned therein proximate to the apex, such that the second aperture is selectively alignable with a first aperture of the respective set of first apertures as the plate is tilted relative to the frame, such that the respective first aperture and the second aperture are positioned for selective insertion of a tilt pin for fixedly positioning the plate relative to the frame.

5. The exercise device of claim 2, further including a pair of handgrips, each of the pair of handgrips being coupled to the plate proximate to a respective opposing side of the plate and extending past the rear edge of the plate, each of the pair of handgrips comprising a first segment and a second segment, the first segment being coupled to the truss such that the first segment is parallel to the plate, the second segment being selectively extensible from and couplable to the first segment.

6. The exercise device of claim 5, wherein:

the first segment of each of the pair of handgrips has a set of first holes positioned therein; and the second segment of each of the pair of handgrips has a set of second holes positioned therein, such that a respective pair of second holes of the set of second holes is selectively alignable with a respective pair of first holes of the set of first holes positioning the respective pair of second holes and the respective pair of first holes for insertion of a hand pin for removably coupling the second segment to the first segment for each of the pair of handgrips.

7. The exercise device of claim 2, further including a pair of rods, each of the pair of rods being pivotally coupled to and extending between the rear segment of a respective side member of the pair of side members and the truss for stabilizing the plate relative to the frame, each of the pair of rods comprising a plurality of nested sections such that the respective rod, is selectively, extensible for allowing tilting of the plate.

8. The exercise device of claim 1, further including a set of feet coupled to the pair of side members wherein the set of feet is configured for stabilizing the frame on the horizontal surface.

9. The exercise device of claim 1, wherein the plate is padded.

10. The exercise device of claim 1, wherein the apex of the frame is positioned between a midpoint of the plate and the front edge of the plate.

11. The exercise device of claim 1, further including a pair of push pins, each of the pair of push pins being coupled to a respective side member of the pair of side members, each of the pair of push pins being spring loaded such that the respective push pin defaults to an inserted position wherein the front segment is fixedly coupled to the rear segment of the respective side member, wherein a knob of each of the pair of push pins is configured for grasping in a hand of the user positioning the user for pulling on the respective push pin for decoupling the front segment from the rear segment of the respective side member for collapsing the frame.

12. The exercise device of claim 1, wherein the resistance module comprises a set of weights.

13. The exercise device of claim 1, wherein the resistance module comprises:

a fastener coupled to the rear segment of one of the pair of side members proximate to the respective side crossbar; and a set of elastomeric bands, each of the set of elastomeric bands being selectively engageable to the fastener and the bar wherein the respective elastomeric band is configured for resisting swinging of the bar.

14. The exercise device of claim 1, wherein the plate has a pair of cutouts positioned therein, each of the pair of cutouts extending from a respective opposing side to the rear edge of the plate, wherein the cutouts are configured for facilitating movement of arms of the user positioned upon the plate.

15. An exercise device comprising:

a frame configured for positioning on a horizontal surface, the frame comprising:

a pair of side members, the pair of side members being inverted V-shaped, a crossmember, the crossmember being coupled to an upper end of each of the pair of side members such that the crossmember extends between the pair of side members, each of the pair of side members comprising a front segment and a rear segment, at least one of the front segment and the rear segment of each of the pair of side members being hingedly coupled to the crossmember such that the frame is selectively collapsible, a pair of side crossbars, each of the pair of side crossbars being coupled to and extending between the front segment and the rear segment of a respective side member of the pair of side members, each of the pair of side crossbars being positioned equally distant from the upper end and a lower end of the respective side member, each of the pair of side crossbars being removably couplable to at least one of the front segment and the rear segment of the respective side member such that the flame is selectively collapsible, and a fastener coupled to the rear segment of one of the pair of side members proximate to the respective side crossbar;

a set of feet coupled to the pair of side members wherein the set of feet are configured for stabilizing the frame on the horizontal surface;

a plate pivotally coupled to an apex of the frame wherein the plate is configured for supporting a torso of a user in a selectable position relative to horizontal with legs of the user extending over a front edge of the plate, the plate being padded, the apex of the frame being positioned between a midpoint and the front edge of the plate;

a truss coupled to and positioned between the plate and the frame, the truss being open rectangularly shaped such that the truss is positioned for retaining the plate in a planar configuration;

a tilting means coupled to the frame, the tilting means being operationally coupled to the plate such that the plate is selectively tiltable relative to the frame, the plate being selectively tillable between −15 and 15 degrees relative to horizontal, the tilting means comprising:

a pair of discs, each of the pair of discs being coupled to the truss and positioned adjacent to a respective side member of the pair of side members proximate to the apex, each of the pair of discs having a set of first apertures positioned therein, and each of the pair of side members having a second aperture positioned therein proximate to the apex, such that the second aperture is selectively alignable with a first aperture of the respective set of first apertures as the plate is tilted relative to the frame, such that the respective first aperture and the second aperture are positioned for selective insertion of a tilt pin for fixedly positioning the plate relative to the flame;

a pair of push pins, each of the pair of pushpins being coupled to a respective side member of the pair of side members, each of the pair of push pins being spring loaded such that the respective push pin defaults to an inserted position wherein the front segment is fixedly coupled to the rear segment of the respective side member, wherein a knob of each of the pair of push pins is configured for grasping in a hand of the user positioning the user for pulling on the respective push pin for decoupling the front segment from the rear segment of the respective side member for collapsing the frame;

a pair of rods, each of the pair of rods being pivotally coupled to and extending between the rear segment of a respective side member of the pair of side members and the truss for stabilizing the plate relative to the frame, each of the pair of rods comprising a plurality of nested sections such that the respective rod is selectively extensible for allowing tilting of the plate;

a bar hingedly coupled to the apex of the frame equally distant from opposing faces of the frame such that the bar is positioned for alternately swinging toward the front edge and a rear edge of the plate when strapped to the legs of the user and with the user moving the legs in a pendulous motion;

a resistance module coupled to the bar distal from the plate wherein the resistance module is configured for resisting swinging of the bar for exercising a lower back of the user, the resistance module comprising at least one of a set of weights and a set of elastomeric bands, each of the set of elastomeric bands being selectively engageable to the fastener and the bar wherein the respective elastomeric band is configured for resisting swinging of the bar;

the plate having a pair of cutouts positioned therein, each of the pair of cutouts extending from a respective opposing side to the rear edge of the plate wherein the cutouts are configured for facilitating movement of arms of the user positioned upon the plate; and a pair of handgrips, each of the pair of handgrips being coupled to the plate proximate to a respective opposing side of the plate and extending past the rear edge of the plate, each of the pair of handgrips comprising:

a first segment coupled to the truss such that the first segment is parallel to the plate, the first segment having a set of first holes positioned therein, and a second segment selectively extensible from and couplable to the first segment, the second segment having a set of second holes positioned therein, such that a respective pair of second holes of the set of second holes is selectively alignable with a respective pair of first holes of the set of first holes positioning the respective pair of second holes and the respective pair of first holes for insertion of a hand pin for removably coupling the second segment to the first segment.

* * * * *